United States Patent [19]

Moser et al.

[11] 4,231,652

[45] Nov. 4, 1980

[54] DRUM FOR ELECTROPHOTOGRAPHIC COPIER

[75] Inventors: Kurt Moser; Helmut Wegmann, both of Gerlingen, Fed. Rep. of Germany

[73] Assignee: Develop KG Dr. Eisbein & Co., Gerlingen, Fed. Rep. of Germany

[21] Appl. No.: 963,217

[22] Filed: Nov. 24, 1978

[30] Foreign Application Priority Data

Dec. 17, 1977 [DE] Fed. Rep. of Germany ..... 2756388

[51] Int. Cl.[3] ..... G03G 15/00

[52] U.S. Cl. ..... 355/3 DR; 242/67.3 R; 355/16

[58] Field of Search ..... 355/3 DR, 16, 3 R; 242/67.3 R

[56] References Cited

U.S. PATENT DOCUMENTS

| | | | |
|---|---|---|---|
| 3,480,361 | 11/1969 | Dol et al. | 355/16 |
| 3,887,278 | 6/1975 | Kolibas | 355/16 |
| 4,076,402 | 2/1978 | Kanno et al. | 355/3 DR |
| 4,114,998 | 9/1978 | Shimizu | 355/3 DR |

*Primary Examiner*—R. L. Moses

*Attorney, Agent, or Firm*—Craig & Antonelli

[57] ABSTRACT

A drum for an electrophotographic copier with the drum serving as an image support and being connected to a rotary drive of the copier, the drum including a stock roll for accommodating a supply of a photosensitive weblike semiconductor material and an empty or takeup roll for receiving the weblike semiconductor material. The semiconductor material is guided over the outer peripheral surface of the drum from the stock roll and is taken up by the empty roll by means of a preferably stepwise adjustable drive. The drum including the stock roll, takeup roll, and semiconductor material form an exchangeable unit adapted to be inserted as a whole into the electrophotographic copier. The drum includes a slit defined by two deflector rolls from which slit the semiconductor material is adapted to be led into and out of the interior of the drum.

34 Claims, 4 Drawing Figures

DRUM FOR ELECTROPHOTOGRAPHIC COPIER

The present invention relates to an electrophotographic copier arrangement and, more particularly, to a drum for an electrophotographic copier which serves as an image support with the drum being mounted in the copier and connected to a rotary drive, the drum containing a stock roll and an empty roll in an interior thereof for accommodating a photosensitive weblike semiconductor material which is adapted to be guided over the outer surface of the drum with the weblike semiconductor material being wound from the stock roll to the empty roll by a preferably stepwise adjustable drive means.

To provide a new semiconductor material on an exterior surface of a drum for an electrophotographic copier after wear or damage to the drum or semiconductor material, Auslegeschrift No. 15 22 151 proposes a drum construction wherein one-half of the drum is adapted to be covered by the semiconductor material while the other half of the drum is constructed almost entirely as a hinged cover which can be opened to provide access to the interior of the drum. In this proposed construction, a lead-out or lead-in slit unilaterally defined by a deflector roll is provided for enabling the weblike material to be led in and out of the interior of the drum.

One disadvantage of this proposed drum construction resides in the fact that by virtue of the semiconductor material only covering half of the drum, a considerable amount of space is required to house the drum if the electrophotographic copier is intended for copying formats larger than DIN A4.

Another disadvantage of the proposed drum construction resides in the fact that the exchanging of the semiconductor web is a relatively laborious task since, after the drum half is opened, the empty roll and stock roll must be removed and exchanged for new rolls and also the operator must lead the semiconductor material from the stock roll, properly position the material along the outer surface of the drum half, feed the material back to the interior of the drum, and attach the end of the material to the empty roll. As can readily be appreciated, because of the number of operations required to exchange the semiconductor material, there arises a considerable number of opportunities for operator error which can adversely affect the overall operation of the electrophotographic copier.

The aim underlying the present invention essentially resides in providing a drum construction of the aforementioned type for an electrophotographic copier which facilitates exchange of the web of semiconductor material.

According to advantageous features of the present invention, a drum is provided which includes a stock roll, empty roll, and semiconductor material with the drum being constructed as an exchangeable unit and being provided with a slit, defined by two deflector rolls, with the semiconductor material being led out and reintroduced through the slit.

By virtue of the above-noted features of the present invention, the drum, constructed as an exchangeable part, may be replaced or exchanged as a whole unit when the semiconductor material is to be renewed thereby eliminating the need for the operator to attempt to reload the drum with new semiconductor material. The removed drum could then be forwarded to the manufacturer for reloading of the semiconductor material and subsequently returned to the user of the electrophotographic copier. As can be appreciated, the reloading of the drum at the manufacturer would require a minimum of time and effort since such reloading would be carried out by trained personnel having the necessary and suitable tools for completing the task.

Since the drum of the present invention is constructed as a so-called exchange part, with semiconductor material, with the user of the electrophotographic copier removing it and returning it to the manufacturer for a new supply of semiconductor material, it is sufficient for the electrophotographic copier user to maintain at least one drum with new semiconductor material in reserve. With such an arrangement, procurement costs and operating costs for the photoelectric copier would not be noticeably affected.

Additionally, since the whole drum of the present invention is removed, almost the entire outer surface of the drum can be covered with the semiconductor material so that copies of large format material are possible without substantially increasing the space required for the electrophotographic copier or providing a drum having substantially large dimensions.

To make the exchange of the complete drum as simple as possible, the drum must be easily attached from the bearing and rotary drive of the electrophotographic copier and must be connected therewith just as easily. For this purpose, according to further advantageous features of the present invention, the drum is provided with connecting means for rapidly connecting and disconnecting the drum to the bearing means and rotary drive means, both of which are fixedly mounted in the copier. By providing such connection means, it is insured that the drum itself will not represent a cumbersome expensive part, but rather the drum as a whole can be maufactured very economically since all possible parts belonging to the bearing and rotary drive means are disposed in a stationary manner in the electrophotographic copier.

Advantageously, according to the present invention, the connecting means may include at least two pins which serve as bearings with the pins being disposed in housing walls of the copier and with the pins being axially adjustable and adapted to be inserted into receiving means provided in the drum.

To permit convenient operation of the invention or removal of the drum by a single individual, according to a further advantageous feature of the present invention, the bearing pins are connected with stop levers which are adapted to be stopped in two end positions by resilient retaining means such as springs or the like.

To provide for the possibility of a simple yet precise connection to the rotary drive of the copier, according to the present invention, the two bearing pins may be connected to the rotary drive and introduced into receiving means provided in the drum so as to be fixed in rotation with the rotary drive.

In accordance with still further features of the present invention, supporting rolls are arranged on the copier housing at a position beneath the drum. The supporting rolls are spaced at a distance from the drum which is less than a distance between engaging elements provided on ends of the bearing pins. By this arrangement it is possible to set the drum into the copier and lay the same on the supporting rollers whereafter the bearing or locking pin automatically lifts the drum from the support rolls as the bearing pins are introduced into the respective receiving means provided in the drum.

According to the present invention, the end surfaces of the drum may be provided with spindles for mounting the empty roll and the stock roll. The spindles may be constructed as sleeves with one of the spindles, for example, the spindle for the empty roll, being coupled to a stationary adjustable drive arrangement. By means of such a drive arrangement, it is possible to cause the weblike semiconductor material to travel by a distance that corresponds to specific copier formats and to readily permit rewinding of the material onto the empty roll.

To insure that the weblike semiconductor material will be kept continuously under tension so that it will reliably lie smoothly on the drum surface, according to yet another especially advantageous feature of the present invention, the spindle which may be coupled to the stationary adjustable drive may be provided with a free wheeling device and loaded in a takeup direction by a tensioning means such as, for example, a helicoidal spring with the direction of rotation of the drum being counter to the direction of tension of the force transmitted by the tensioning means to the web of the semiconductor material on the outer surface of the drum.

To minimize if not avoid any imbalancing of the drum and to insure that any imbalance will not adversely influence the efficiency of the electrophotographic copier and also to insure that the vibrations of the drive means will be suitably damped, according to the present invention, a brake block may be disposed on the copier housing with the brake block being elastically pressed against a face of the drum.

To insure that a sufficient quantity of the semiconductor material is withdrawn from the supply roll so as to cover the periphery of the drum in accordance with the predetermined formats being copied, according to a further advantageous feature of the present invention, an auxiliary means may be provided for indicating a sufficient withdrawal of material with the indicating means being in the form of at least one of an optical or acoustic signal.

Accordingly, it is an object of the present invention to provide a drum arrangement for an electrophotographic copier which avoids, by simple means, shortcomings and disadvantages encountered in the prior art.

Another object of the present invention resides in providing a drum arrangement for an electrophotographic copier which simplifies the necessary operations for exchanging a semiconductor material of the drum.

Yet another object of the present invention resides in providing a drum arrangement for an electrophotographic copier which minimizes the space requirements for housing the drum inside the copier and yet permits the copying of material having relatively large formats.

A further object of the present invention resides in providing a drum arrangement for an electrophotographic copier which is constructed as an exchangeable part and which may be replaced as a whole in the electrophotographic copier. A still further object of the present invention resides in providing a drum for an electrophotographic copier which is simple in construction and therefore relatively inexpensive to manufacture.

Another object of the present invention resides in providing a drum for an electrophotographic copier which functions reliably under all operating conditions.

A further object of the present invention resides in providing a drum for an electrophotographic copier which insures the proper positioning of a semiconductor material along the outer peripheral surface of the drum arrangement.

In another object the present invention resides in providing a drum for an electrophotographic copier which may readily be replaced in the copier by unskilled personnel in a minimum of time.

These and other objects, features, and advantages of the present invention will become more apparent from the following description when taken in connection with the accompanying drawings, which show, for the purposes of illustration only, one embodiment in accordance with the present invention, and wherein.

Figure 1:
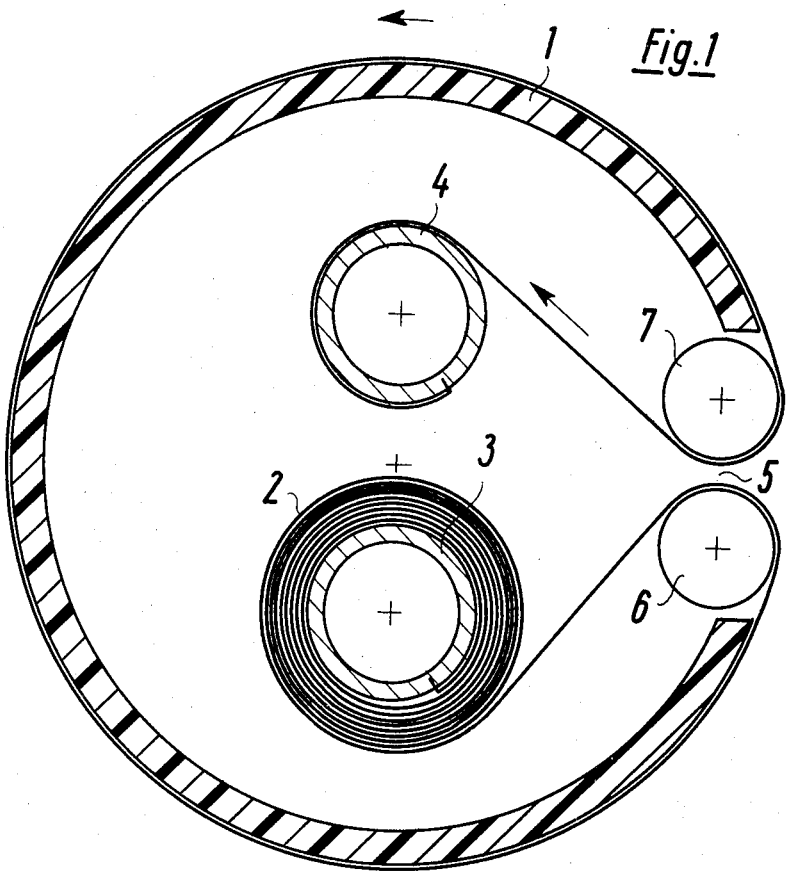
FIG. 1 is a vertical cross-sectional view through a drum arrangement for an electrophotographic copier in accordance with the present invention.

Referring now to the drawings wherein like reference numerals are used throughout the various views to designate like parts and, more particularly to FIG. 1, according to this figure, a hollow drum 1 has a stock roll 3 wound with a semiconductor material 2 and an empty roll 4 disposed in an interior thereof. A longitudinally extending slit 5 is provided in the drum 1 with the slit 5 being defined by two deflector rolls 6,7. The weblike semiconductor material 2 is drawn from the stock roll 3 and led out of the interior of the drum through the slit 5 by way of the deflector roll 6. The weblike semiconductor material 2 is then passed about or positioned along the outer surface of the drum 1 and led back into the interior of the drum 1 by way of the slit 5 and deflector roll 7. After the weblike semiconductor material 2 is led back into the interior of the drum 1, the end of the material 2 is then fixed on the empty roll 4 in a conventional manner not shown in detail in the drawings.

The drum 1 covered with the semiconductor material 2 functions as an image support for a photoelectric copier with an electrostatic charge of uniform configuration first being applied to the drum 1 which, by illumination is converted to a charge relief pattern corresponding to an original being copied. The charge relief pattern is developed by means of a developer station (not shown). Thereafter, the developed image is transferred to a copy paper and the drum 1 is cleansed of any toner material that may still be adhering thereto. The drum 1 is then again uniformly charged so that the above-described copying process can be repeated in a known manner.

Since the drum 1 has only one slit 5 from which the semiconductor material is led in and out, almost the entire outer surface of the drum can be utilized for the copying process since the only interruption in the outer surface of the drum 1 is the slit 5 which represents a relatively small percentage of the total surface of the drum 1.

Since the outer surface of the drum 1 is continuous with the exception of the slit 5, in such an arrangement, the semiconductor material 2 cannot readily be inserted into the drum 1, positioned around the drum 1 from the stock roll 3, and again wound on the empty roll 4 without considerable difficulty or without a complete disassembly of the drum 1. Consequently, the whole drum 1 with the semiconductor material 2, stock roll 3, and empty roll 4, as well as the deflector rolls 6 and 7 is constructed as an exchangeable unit.

Figure 2:
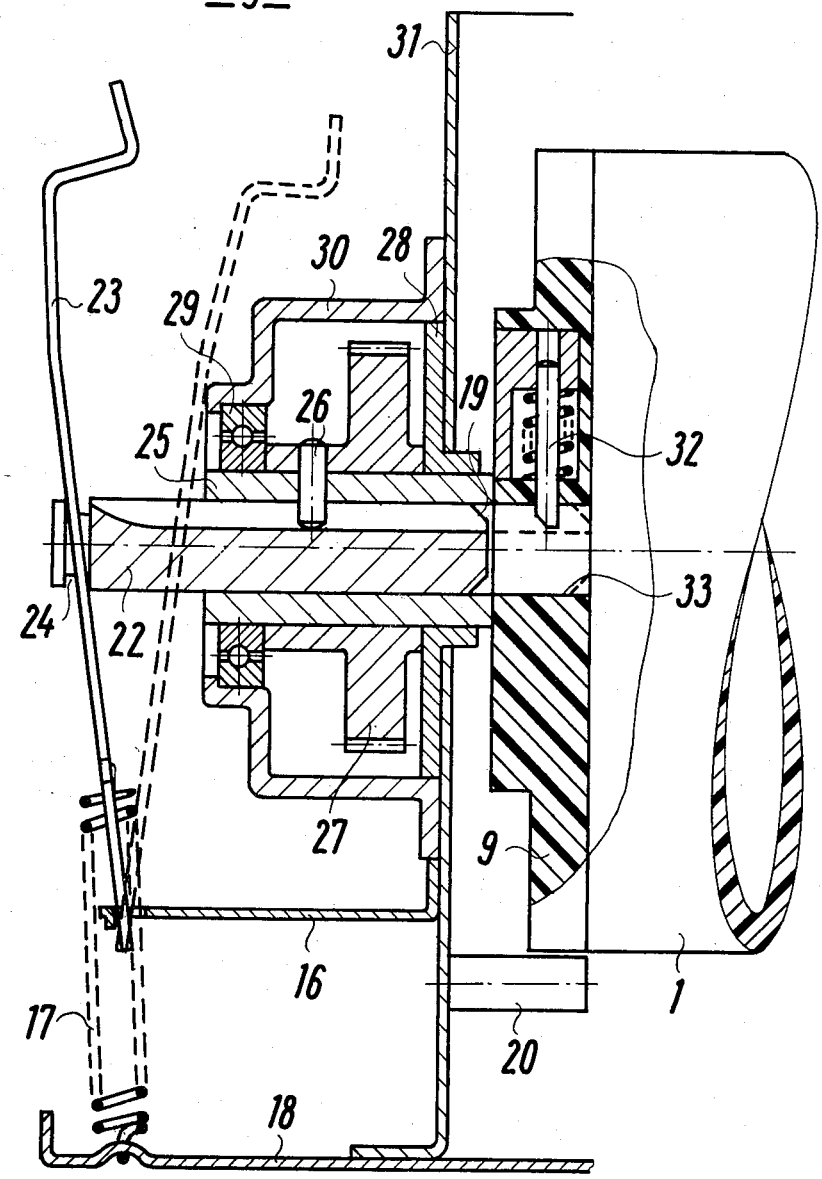
FIG. 2 is an axial partial cross-sectional view of the drum arrangement of FIG. 1 illustrating a bearing means and rotary drive means of an appurtenant electrophotographic copier.
Figure 3:
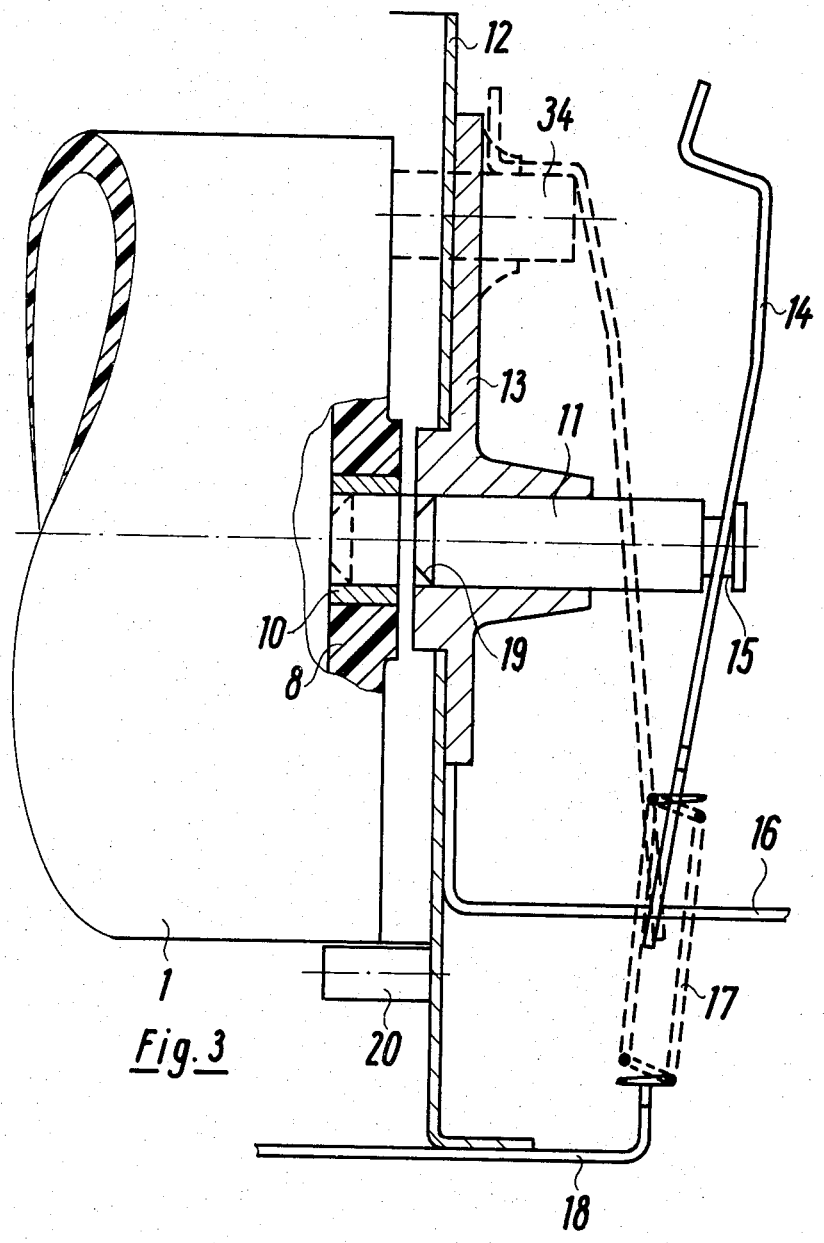
FIG. 3 is an axial partial cross-sectional view through an opposite end of the drum arrangement of FIG. 2 illustrating the bearing means of the appurtenant electrophotographic copiers.
Figure 4:
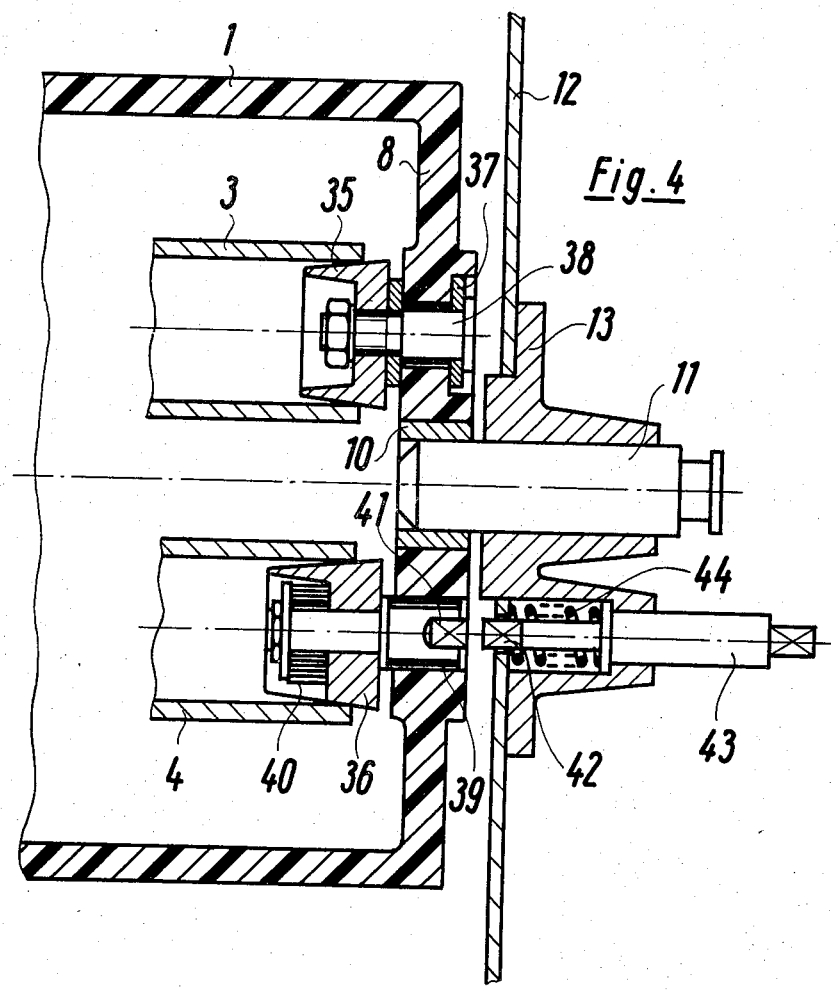
FIG. 4 is an axial partial cross-sectional view through an end of the drum arrangement of FIG. 3 taken along another plane.

As shown in FIGS. 2 and 3, the drum 1 is constructed as a sleeve-like plastic part and includes a front wall 8 and a cover 9 for closing the respective ends thereof. The front wall 8 is provided with a bore which accommodates a bearing ring 10 made of a sintered material. A bearing pin 11, mounted in the housing of the copier, is adapted to be introduced into the bearing ring 10. The bearing pin 11 is disposed in the copier so as to be radially fixed but axially adjustable whereby the pin 11 may readily penetrate into the bearing ring 10 or be withdrawn therefrom. A bearing cover 13 is fixed on a housing wall 12 of the copier. The bearing cover 13 is provided with a bore for receiving the bearing pin 11. The bearing pin 11 being moveably received in the bearing cover 13 so as to be coaxial with respect to the drum 1.

A stop lever 14, adapted to be reintroduced into a recess or annular groove of the bearing pin 11, is provided for permitting an adjustment of the bearing pin 11. The stop lever 14 bears, at its lower end, on a retaining plate 16. A tension spring 17 engages the stop lever 14 at a position between the deflection of the stop lever 14 at the annular groove 15 of the bearing pin 11 and the bearing point of the stop lever 14 on the retaining plate 16. The other end of the tension spring 17 is suspended on a floor or bottom wall 18 of the copier. The bearing point or position of the stop lever 14 on the retaining plate 16 and the deflection of the tension spring 17 is so selected that the stop lever 14, in a movement from an inoperative position, indicated by solid lines in FIGS. 2 and 3, into an operative position, indicated by dashed lines in such figures, passes through a dead center position or point so that the tension spring 17 will stop the stop lever 14 and therewith the bearing pin 11 in both end positions, that is, in the illustrated end position in which the bearing pin 11 is pulled back from the bearing ring and in the end position indicated in dashed lines in which the bearing pin 11 is accommodated in the bore of the bearing ring 10.

To support the drum 1 after removal of the bearing pin 11 and to facilitate the mounting of the drum at the bearing pin 11, at least one supporting roll 20 is provided at the housing wall 12. The bearing pin 11 is provided with a relatively large engaging element 19 with the supporting roll or rolls 20, disposed below the drum 1, having a distance from the drum 1 which is less than the engaging element 19 so that it is possible to set the drum 1 in such a way that it will be applied with its outer surface on the supporting roll 20 whereby, after an actuation of the stop lever 14, the bearing pin 11, because of the engaging element 19, will be reliably inserted into the bearing ring 10 and the drum 1 will automatically be lifted off the supporting roll or rolls 20.

As shown in FIG. 2, a similar bearing pin 22 is provided at the opposite end of the drum 1, that is, for the front wall of the drum 1 formed by the cover 9. The bearing pin 22 is axially moveable in a manner corresponding to the bearing pin 11 with a stop lever 23 being engageable with a recess or annular groove 24 of the bearing pin 22 and bearing on a retaining plate 16. Stop lever 23 is loaded by a tension spring 17, which, like stop lever 14, is suspended on a floor or bottom wall 18 of the copier so that a dead center override safety position is obtained for both end positions of the stop lever 23.

The bearing pin 22, as shown in FIG. 2, is a component of a rotary drive means fixedly disposed on the copier housing with the drive means transmitting a turning motion to the drum 1. The bearing pin 22 is disposed in a sliding sleeve 25 and is connected by way of a drive pin or tappet 26 with a drive gear 27 so that the bearing pin 22 is fixed in rotation with the drive gear 27. The gear 27 is connected to a drive motor (not shown) in a conventional manner. The sliding sleeve 25 is carried in a housing cover 30 and sidewall 31 of the copier with a bearing ring 28, of sintered material, and a ball bearing means 29 being provided for mounting the respective ends of the sleeve 25 at the cover 30 and sidewall 31.

A radially moveable resiliently held stop pin 32 is mounted at the cover 9. The stop pin 32 is adapted to be engaged by the bearing pin 22 when, in setting the drum, an axial groove of the bearing pin is not in a region of the stop pin. However, after a rotation of the drum 1, the stop pin 32 will engage the axial groove of the bearing pin 22.

Additionally, on the side of the rotary drive means of the copier, at least one supporting roll 20 is disposed beneath the drum 1 at a distance which is less than the engaging element 19 of the bearing pin 22 so that, as with the bearing pin 11, with the drum 1 being disposed on the supporting roll 20, the bearing pin 22 can automatically be introduced into the bore 33 of the front wall or cover 9 of the drum 1.

To remove the entire drum including the stock and feed rolls 4, 3, deflector rolls 5,6, and semiconductor material 2, stop levers 14 and 23 are moved back into the positions indicated in solid lines in FIGS. 2 and 3. In such position, the stop levers 14 and 23 are stopped by tension spring 17 because of the dead center positions thereof. The drum 1 then falls down onto the support rolls 20 where it can then be grasped and taken out. A new drum 1 or a drum 1 newly supplied with semiconductor material is then set into the copier so that it lies on the supporting rolls 20. Thereafter, stop levers 14 and 23 are displaced to the dashed line positions of FIGS. 2 and 3 whereby the bearing pins 11 and 22 are introduced into the bearing ring 10 and bore 33, respectively, without the user having to do any ancillary work such as, for example, lifting the drum 1 or the like. If necessary, the drum 1 may be turned so as to insure that the stop pin 32 will lock in the axial groove of the bearing 22 thereby establishing a following connection between the rotary drive of the copier and the drum 1 in the peripheral direction.

As shown in FIG. 3, a brake block 34 may be set in the bearing cover 13 with the brake block 34 extending through the wall 12 of the copier and being adapted to be applied to an end wall 8 of the drum 1. The brake block 34 is elastically pressed by an upper part (not shown) of the copier and the stop lever 14 against the drum 1 in such a way, not shown in detail, that upon a closing of the copier housing, the effect of imbalances of the drum 1 and vibration of the drive means are excluded.

Both the empty roll 4 and stock roll 3 are constructed as sleeves with respective ends of the rolls 3,4 being adapted to be thrust or mounted on spindles 35 and 36 disposed in the front wall 8 and cover 9 of the drum 1. The spindle 35 is fixed on a pin 38 that is elastically held in an axial direction by a plate spring 37 whereby, in this arrangement, the bearing of the pin 38 is effected in such a way that the bearing pin 38 and spindle 39 do not readily turn but rather a most precisely defined torque that is possible is applied so as not to produce a twisting action. The opposite end of the stock roll 3 is borne with a correspondingly disposed spindle 35 in the cover 9.

The spindle 36 for the empty sleeve or takeup roll 4 is rotatably disposed about a pin of a free wheeling device 39. Between the pin of the free wheeling device 39 and spindle 38, a helicoidal spring 40 is provided for loading the spindle 36 with a torque in a takeup direction of the empty or takeup roll 4 whereby there is always a tension on the weblike semiconductor material which is guided from the stock roll 3 over the surface of the drum 1 to the empty or takeup roll 4.

The free wheeling device 39 is provided with a polygonal recess which is disposed opposite a corresponding polygonal end 42 of an axially adjustable pin 43. The pin 43 is disposed in the bearing cover 13 and is loaded by a compression spring 44 in such a way that, in its normal position, the polygonal end 42 of the pin 43 is out of the region or area of the free wheeling device 39. However, the pin 43 may be displaced, against the action of the spring 44, so that the polygonal end 42 of the pin 43 is inserted into the recess 41 whereby a twisting or turning of the empty roll 4 can, advantageously, be effected manually so as to cause a winding up of the used or damaged semiconductor material 2 on the roll 4. The outer end of the pin 43 may also be provided with a polygonal end for receiving, for example, a hand wheel, crank, or the like. As can be appreciated, the turning of the empty or takeup roll 4 to draw off and wind up a specific length of semiconductor material may be effected either manually or automatically.

While we have shown and described only one embodiment in accordance with the present invention, it is understood that the same is not limited thereto but is susceptible of numerous changes and modifications as known to one having ordinary skill in the art, and we therefore do not wish to be limited to the details shown and described herein but intend to cover all such modifications as are encompassed by the scope of the appended claims.

We claim:

1. A drum for an electrophotographic copier, the drum including an interior space, a stock roll means disposed in the interior space for accommodating a supply of weblike photosensitive semiconductor material, a takeup roll means disposed in the interior space for receiving the semiconductor material from said stock roll means, the semiconductor material extends from the stock roll means around an outer peripheral surface of the drum to the takeup roll means, characterized in that at least two deflector roll means are arranged at the drum for defining a slit means for enabling the semiconductor material to be led into and out of the interior space of the drum, the drum including the stock roll means, takeup roll means, and semiconductor material are constructed as an exchangeable unit adapted to be inserted into the electrophotographic copier, and in that quick release means are provided on the drum for connecting the drum to bearing means and a rotary drive means of the electrophotographic copier, said quick release means includes means for accommodating axially adjustable bearing pins arranged at the bearing means and rotary drive means of the electrophotographic copier.

2. A drum according to claim 1, characterized in that means are provided on the drum for fixing the drum for rotation with the bearing pin arranged at the rotary drive means of the electrophotographic copier.

3. A drum according to claim 2, characterized in that said fixing means includes a radially moveable pin means adapted to be engageable with the bearing pin arranged at the rotary drive means, and in that means are provided for normally urging the radially moveable pin means in a direction of the last mentioned bearing pin.

4. A drum according to claim 2, characterized in that means are provided at axial end faces of the drum for mounting said supply roll means and said takeup roll means in the interior space of the drum, and in that a further drive means is provided for driving one of said stock roll means or said takeup roll means.

5. A drum according to claim 4, characterized in that said mounting means include a pair of spindles for accommodating the respective roll means, said further drive means is coupled to one of the spindles for the takeup roll means, and in that a free wheeling means is mounted on said one of said spindles, means are provided for biasing said further drive means into a drive position.

6. A drum according to claim 5, characterized in that said further driving means is stepwise adjustable.

7. A drum according to claim 6, characterized in that said biasing means is a helicoidal spring.

8. A drum according to claim 5, characterized in that a direction of rotation of the drum is opposite to a direction of tension of the force transmitted by said biasing means to the semiconductor material disposed around the outer peripheral surface of the drum.

9. A drum according to claim 8, characterized in that means are provided for minimizing effects of imbalance of the drum and for damping vibration of the rotary drive means of the electrophotographic copier.

10. A drum according to claim 9, characterized in that said last mentioned means includes a brake block means adapted to be elastically applied against an end face of the drum.

11. A drum arranged within an electrophotographic copier, the drum including an interior space, a stock roll means disposed in the interior space for accommodating a supply of weblike photosensitive semiconductor material, a takeup roll means disposed in the interior space for receiving the semiconductor material from said stock roll means, the semiconductor material extends from the stock roll means around an outer peripheral surface of the drum to the takeup roll means, characterized in that at least two deflector roll means are arranged at the drum for defining a slit means for enabling the semiconductor material to be led into and out of the interior space of the drum, the drum including stock roll means, takeup roll means, and semiconductor material are constructed as an exchangeable unit adapted to be inserted into the electrophotographic copier, the copier includes opposed copier housing walls, a plurality of bearing pin means, means for mounting at least one of the bearing pin means at each of the opposed housing walls so as to be axially adjustable, and in that means are provided in the drum for receiving the axially adjustable bearing pin means.

12. A drum according to claim 11, characterized in that the copier further includes stop lever means for each of the bearing pin means, and in that means are provided for stopping the stop lever means in an operative position with the respective bearing pin means being disposed in the receiving means of the drum and an inoperative position with the respective bearing pin means being withdrawn from the receiving means.

13. A drum according to claim 12, characterized in that said stopping means for said stop lever means includes at least one tension spring means operatively connected with the respective stop lever means.

14. A drum according to claim 13, characterized in that the copier further includes a rotary drive means, one of the two bearing pin means is connected to the rotary drive means for rotation therewith, and in that means are provided for drivingly connecting the drum with said one of said two bearing pin means such that the drum rotates with said bearing pin means.

15. A drum according to claim 14, characterized in that said bearing pin means connected to the rotary drum means includes an axially extending groove means, said means for drivingly connecting the drum includes at least one radially moveable lock pin means engageable with said axially extending groove means.

16. A drum according to claim 15, characterized in that means are provided for normally urging said lock pin means in a direction toward said bearing pin means connected with the rotary drum means.

17. A drum according to one of claims 11, 12, or 14, characterized in that means are provided at the opposed copier housing walls for supporting the drum in the copier at a position relative to the bearing pin means such that, upon axial displacement of the respective bearing pin means into the receiving means of the drum, the drum is automatically lifted off said supporting means.

18. A drum according to claim 17, characterized in that said supporting means includes at least one support roll provided at each of the opposed copier housing walls.

19. A drum according to claim 17, characterized in that means are provided at each of the end faces of the drum for mounting said supply roll means and said takeup roll means in the interior space of the drum, and in that a drive means is provided for driving one of said stock roll means said takeup roll means.

20. A drum according to claim 19, characterized in that said mounting means includes a pair of spindles for accommodating the respective roll means, said drive means for driving one of said stock roll means or said takeup roll means is coupled to one of the spindles for the takeup roll means, and in that a free wheeling means is mounted on said one of said spindles, means are provided for biasing said last-mentioned drive means into a drive position.

21. A drum according to claim 20, characterized in that said biasing means is a helicoidal spring.

22. A drum according to claim 20, characterized in that a direction of rotation of the drum is opposite a direction of tension of a force transmitted by said biasing means to the semiconductor material disposed around the outer peripheral surface of the drum.

23. A drum according to claim 22, characterized in that means are provided for minimizing effects of imbalance of the drum and for damping vibration of the rotary drive means of the electrophotographic copier.

24. A drum according to claim 23, characterized in that said last mentioned means includes a brake block means disposed on one of the opposed copier housing walls, and in that means are provided for elastically applying the brake block means against an end face of the drum.

25. A drum according to claim 11, characterized in that each of said bearing pin means include an engaging means adapted to engage the receiving means of the drum.

26. A drum according to claim 25, characterized in that the copier includes a stop lever means for each of the bearing pin means, each of said stop lever means having a portion adapted to engage an annular groove provided in an associated bearing pin means, and in that means are provided for stopping the stop lever means in an operative position with the respective bearing pin means being disposed in the receiving means of the drum and an inoperative position with the respective bearing pin means being withdrawn from the receiving means.

27. A drum according to claim 26, characterized in that the copier further includes a bottom wall and a retaining plate disposed above said bottom wall, one end of each of said stop lever means being adapted to bear against the retaining means, and in that the stopping means for said stop lever means includes a tension spring means secured to the bottom wall of the copier and operatively connected to the respective stop lever means at a position such that, upon a movement of the respective stop lever means from the operative to the inoperative positions, the respective stop lever means pass through a dead center position.

28. A drum for an electrophotographic copier, the drum including an interior space, a stock roll means disposed in the interior space for accommodating a supply of weblike photosensitive semiconductor material, a takeup roll means disposed in the interior space for receiving the semiconductor material from said stock roll means, the semiconductor material extends from the stock roll means around an outer peripheral surface of the drum to the takeup roll means, characterized in that at least two deflector roll means are arranged at the drum for defining a slit means for enabling the semiconductor material to be led into and out of the interior space of the drum, the drum including the stock roll means, takeup roll means, and semiconductor material are constructed as an exchangeable unit adapted to be inserted into the electrophotographic copier, quick release means are provided on the drum for connecting the drum to bearing means and a rotary drive means of the electrophotographic copier, means are provided at axial end faces of the drum for mounting said supply roll means and said takeup roll means in the interior space of the drum, and a further drive means is provided for driving one of said stock roll means or said takeup roll means, said further drive means including an axially displaceable pin means mounted at a bearing cover of the bearing means and adapted to be selectively displaceable into a driving connection with one of said stock roll means or said takeup roll means, and in that means are provided for normally biasing the axially displaceable pin means into a non-driving position.

29. A drum according to claim 28, characterized in that said mounting means includes a pair of spindles for accommodating the respective roll means, means are provided for coupling said axially displaceable pin means of said further drive means to one of the spindles for the takeup roll means, and in that a free wheeling means is mounted on said one of said spindles.

30. A drum according to one of claims 28 or 29 characterized in that said driving means is stepwise adjustable.

31. A drum according to claim 30, characterized in that said biasing means is a helicoidal spring.

32. A drum according to one of claims 28 or 29, characterized in that a direction of rotation of the drum is opposite to a direction of tension of the force transmitted by said biasing means to the semiconductor material disposed around the outer peripheral surface of the drum.

33. A drum according to claim 32, characterized in that means are provided for minimizing effects of imbalance of the drum and for damping vibration of the rotary drive means of the electrophotographic copier.

34. A drum according to claim 33, characterized in that said last mentioned means includes a brake block means adapted to be elastically applied against an end face of the drum.

* * * * *

UNITED STATES PATENT AND TRADEMARK OFFICE

CERTIFICATE OF CORRECTION

PATENT NO. : 4,231,652

DATED : November 4, 1980

INVENTOR(S) : Kurt MOSER; Helmut WEGMANN

It is certified that error appears in the above-identified patent and that said Letters Patent are hereby corrected as shown below:

The front page of the patent should indicate the following:

"Assignee: Develop Dr. Eisbein GmbH and Co."

Signed and Sealed this

*Thirtieth* Day of *June 1981*

[SEAL]

*Attest:*

RENE D. TEGTMEYER

*Attesting Officer*

*Acting Commissioner of Patents and Trademarks*